US009002049B2

(12) United States Patent
Higgins et al.

(10) Patent No.: US 9,002,049 B2
(45) Date of Patent: Apr. 7, 2015

(54) HOUSING FOR A STANDARD FIT HEARING ASSISTANCE DEVICE

(75) Inventors: Sidney A. Higgins, Maple Grove, MN (US); Aaron Jon Schroeder, Savage, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 334 days.

(21) Appl. No.: 12/982,181

(22) Filed: Dec. 30, 2010

(65) Prior Publication Data

US 2012/0087526 A1 Apr. 12, 2012

Related U.S. Application Data

(60) Provisional application No. 61/391,521, filed on Oct. 8, 2010.

(51) Int. Cl.
*H04R 25/00* (2006.01)

(52) U.S. Cl.
CPC ..... *H04R 25/602* (2013.01); *H04R 25/65* (2013.01); *H04R 25/656* (2013.01); *H04R 25/652* (2013.01); *H04R 25/654* (2013.01); *H04R 2225/023* (2013.01); *H04R 2460/17* (2013.01); *H04R 25/604* (2013.01); *H04R 25/658* (2013.01)

(58) Field of Classification Search
USPC ..... 381/321, 324, 326, 325, 328, 318; 181/130, 135
See application file for complete search history.

(56) References Cited

U.S. PATENT DOCUMENTS

| | | | | |
|---|---|---|---|---|
| 2,430,229 | A | 11/1947 | Kelsey | |
| 4,532,649 | A | 7/1985 | Bellafiore | |
| 4,598,177 | A * | 7/1986 | McGroarty et al. | 381/323 |
| 4,870,688 | A | 9/1989 | Voroba et al. | |
| 4,937,876 | A * | 6/1990 | Biermans | 381/324 |
| 4,962,537 | A * | 10/1990 | Basel et al. | 381/324 |
| 5,046,580 | A | 9/1991 | Barton | |
| 5,201,007 | A | 4/1993 | Ward et al. | |
| 5,220,612 | A | 6/1993 | Tibbetts et al. | |
| 5,327,500 | A * | 7/1994 | Campbell | 381/325 |

(Continued)

FOREIGN PATENT DOCUMENTS

| | | | |
|---|---|---|---|
| DE | 3917804 | A1 | 12/1990 |
| DE | 4232317 | A1 | 5/1993 |

(Continued)

OTHER PUBLICATIONS

"U.S. Appl. No. 12/982,215 , Response filed Apr. 29, 2013 to Non Final Office Action mailed Nov. 29, 2012", 11 pgs.

(Continued)

*Primary Examiner* — Amal Zenati
*Assistant Examiner* — Sunita Joshi
(74) *Attorney, Agent, or Firm* — Schwegman Lundberg & Woessner, P.A.

(57) ABSTRACT

A hearing aid kit includes a standard fit, completely-in-canal (CIC) hearing aid and a hearing aid tool set. The CIC hearing aid is for extended use and includes a core module inserted into a sleeve. The core module and the sleeve each include various features providing for a minimum overall size, ease of insertion, removal, and cleaning, and enhanced sound transmission. The tool set is configured to be stored and carried in a single piece and provides for adjustment and cleaning of the CIC hearing aid. Open ear fits and occlusive ear fits are possible using different sleeves.

24 Claims, 14 Drawing Sheets

(56) References Cited

U.S. PATENT DOCUMENTS

| | | | | |
|---|---|---|---|---|
| 5,404,105 | A | 4/1995 | Chari et al. | |
| 5,478,304 | A | 12/1995 | Webster | |
| 5,572,594 | A | 11/1996 | Devoe et al. | |
| 5,654,530 | A | 8/1997 | Sauer et al. | |
| 5,659,621 | A | 8/1997 | Newton | |
| 5,675,657 | A | 10/1997 | Giannetti | |
| 5,682,020 | A | 10/1997 | Oliveira | |
| 5,701,348 | A | 12/1997 | Shennib et al. | |
| 5,920,636 | A | 7/1999 | Oliveira et al. | |
| 5,979,589 | A | 11/1999 | Aceti | |
| 6,022,311 | A | 2/2000 | Juneau et al. | |
| 6,094,493 | A | 7/2000 | Borowsky et al. | |
| 6,137,889 | A * | 10/2000 | Shennib et al. | 381/328 |
| 6,179,085 | B1 | 1/2001 | Brimhall et al. | |
| 6,205,227 | B1 | 3/2001 | Mahoney | |
| 6,208,741 | B1 | 3/2001 | Shennib | |
| 6,212,283 | B1 | 4/2001 | Fletcher et al. | |
| 6,228,020 | B1 | 5/2001 | Juneau et al. | |
| 6,254,526 | B1 | 7/2001 | Juneau et al. | |
| 6,354,990 | B1 | 3/2002 | Juneau et al. | |
| 6,359,993 | B2 | 3/2002 | Brimhall | |
| 6,382,346 | B2 | 5/2002 | Brimhall et al. | |
| 6,432,247 | B1 | 8/2002 | Juneau et al. | |
| 6,434,248 | B1 | 8/2002 | Juneau et al. | |
| 6,438,244 | B1 | 8/2002 | Juneau et al. | |
| 6,456,720 | B1 | 9/2002 | Brimhall et al. | |
| 6,473,512 | B1 | 10/2002 | Juneau et al. | |
| 6,473,513 | B1 | 10/2002 | Shennib | |
| 6,516,074 | B1 | 2/2003 | Brinhall et al. | |
| 6,532,295 | B1 | 3/2003 | Brimhall et al. | |
| 6,546,108 | B1 | 4/2003 | Shennib et al. | |
| 6,567,527 | B1 | 5/2003 | Baker et al. | |
| 6,695,943 | B2 | 2/2004 | Juneau et al. | |
| 6,724,902 | B1 | 4/2004 | Shennib et al. | |
| 6,728,383 | B1 | 4/2004 | Juneau et al. | |
| 6,751,327 | B1 | 6/2004 | Urso | |
| 6,761,789 | B2 | 7/2004 | Juneau et al. | |
| 6,914,994 | B1 * | 7/2005 | Shennib et al. | 381/312 |
| D509,054 | S | 9/2005 | Shennib et al. | |
| 6,940,988 | B1 | 9/2005 | Shennib et al. | |
| 6,940,989 | B1 | 9/2005 | Shennib et al. | |
| 6,993,142 | B2 | 1/2006 | Bordewijk | |
| 7,010,137 | B1 | 3/2006 | Leedom et al. | |
| 7,016,504 | B1 | 3/2006 | Shennib | |
| 7,016,511 | B1 | 3/2006 | Shennib | |
| 7,092,543 | B1 | 8/2006 | Mahoney et al. | |
| D534,277 | S | 12/2006 | Shennib et al. | |
| 7,215,789 | B2 | 5/2007 | Shennib et al. | |
| 7,217,335 | B2 | 5/2007 | Juneau et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,313,245 | B1 | 12/2007 | Shennib | |
| 7,359,524 | B2 | 4/2008 | Bordewijk | |
| 7,362,875 | B2 | 4/2008 | Saxton et al. | |
| 7,379,555 | B2 | 5/2008 | Gable et al. | |
| 7,388,961 | B2 | 6/2008 | Shennib et al. | |
| 7,424,123 | B2 | 9/2008 | Shennib et al. | |
| 7,424,124 | B2 | 9/2008 | Shennib et al. | |
| 7,466,836 | B2 | 12/2008 | Tilson et al. | |
| 7,477,753 | B2 | 1/2009 | Buckley et al. | |
| 7,508,951 | B2 | 3/2009 | Bordewijk | |
| 7,536,023 | B2 | 5/2009 | Leedom | |
| 7,551,747 | B2 | 6/2009 | Huynh et al. | |
| 7,558,394 | B2 | 7/2009 | Tilson et al. | |
| 7,580,537 | B2 | 8/2009 | Urso et al. | |
| 7,664,282 | B2 | 2/2010 | Urso | |
| 7,726,711 | B1 | 6/2010 | Seltzer | |
| 7,940,946 | B2 | 5/2011 | Caldarola | |
| 8,284,974 | B2 | 10/2012 | Pander et al. | |
| 2001/0017230 | A1 | 8/2001 | Brimhall et al. | |
| 2001/0043708 | A1 | 11/2001 | Brimhall et al. | |
| 2002/0032362 | A1 | 3/2002 | Juneau et al. | |
| 2002/0198437 | A1 | 12/2002 | Juneau et al. | |
| 2004/0165742 | A1 | 8/2004 | Shennib et al. | |
| 2004/0252854 | A1 | 12/2004 | Juneau et al. | |
| 2004/0258263 | A1 | 12/2004 | Saxton et al. | |
| 2005/0049471 | A1 | 3/2005 | Aceti | |
| 2005/0141739 | A1 | 6/2005 | Juneau | |
| 2005/0190938 | A1 | 9/2005 | Shennib et al. | |
| 2005/0196005 | A1 | 9/2005 | Shennib et al. | |
| 2005/0249370 | A1 | 11/2005 | Shennib et al. | |
| 2005/0259840 | A1 | 11/2005 | Gable et al. | |
| 2006/0002574 | A1 | 1/2006 | Shennib et al. | |
| 2006/0050914 | A1 | 3/2006 | Urso et al. | |
| 2006/0126876 | A1 | 6/2006 | Shennib | |
| 2006/0159298 | A1 | 7/2006 | von Dombrowski et al. | |
| 2006/0210090 | A1 | 9/2006 | Shennib | |
| 2006/0210104 | A1 | 9/2006 | Shennib et al. | |
| 2006/0215862 | A1 * | 9/2006 | Huynh et al. | 381/324 |
| 2006/0291682 | A1 | 12/2006 | Urso et al. | |
| 2006/0291683 | A1 | 12/2006 | Urso et al. | |
| 2007/0003081 | A1 | 1/2007 | Ram et al. | |
| 2007/0003084 | A1 | 1/2007 | Huynh et al. | |
| 2007/0003086 | A1 | 1/2007 | Tilson et al. | |
| 2007/0003087 | A1 | 1/2007 | Ram et al. | |
| 2007/0009106 | A1 | 1/2007 | Tilson et al. | |
| 2007/0019832 | A1 | 1/2007 | Bordewijk | |
| 2007/0036379 | A1 | 2/2007 | Anderson et al. | |
| 2007/0154042 | A1 | 7/2007 | Buckley et al. | |
| 2007/0291971 | A1 | 12/2007 | Halteren | |
| 2008/0031482 | A1 | 2/2008 | Shennib et al. | |
| 2008/0063231 | A1 | 3/2008 | Juneau et al. | |
| 2008/0069386 | A1 | 3/2008 | Gable et al. | |
| 2008/0123889 | A1 | 5/2008 | Caldarola | |
| 2008/0137892 | A1 | 6/2008 | Shennib et al. | |
| 2009/0060245 | A1 | 3/2009 | Blanchard et al. | |
| 2009/0074220 | A1 * | 3/2009 | Shennib | 381/325 |
| 2009/0116677 | A1 | 5/2009 | Jones et al. | |
| 2009/0238389 | A1 | 9/2009 | Tilson et al. | |
| 2009/0262964 | A1 | 10/2009 | Havenith et al. | |
| 2009/0316940 | A1 | 12/2009 | Pander et al. | |
| 2010/0128914 | A1 | 5/2010 | Khenkin | |
| 2010/0322452 | A1 | 12/2010 | Ladabaum et al. | |
| 2011/0103629 | A1 | 5/2011 | Sjursen et al. | |
| 2012/0087527 | A1 | 4/2012 | Higgins et al. | |
| 2012/0087528 | A1 | 4/2012 | Higgins | |

FOREIGN PATENT DOCUMENTS

| | | | |
|---|---|---|---|
| EP | 0245739 | | 6/2002 |
| EP | 1341397 | A2 | 9/2003 |
| EP | 1368990 | B1 | 7/2007 |
| EP | 2050307 | | 1/2008 |
| EP | 2297974 | | 12/2009 |
| JP | H7-131898 | | 5/1995 |
| JP | 2009278403 | A | 11/2009 |
| WO | WO-9213430 | A1 | 8/1992 |
| WO | WO-9221218 | A1 | 11/1992 |
| WO | WO-9939548 | | 8/1999 |
| WO | WO-0042817 | A1 | 7/2000 |
| WO | WO-0234010 | | 4/2002 |
| WO | WO-0234010 | A2 | 4/2002 |
| WO | WO-03049496 | A1 | 6/2003 |
| WO | WO-2004010734 | A1 | 1/2004 |
| WO | WO-2004032565 | A2 | 4/2004 |
| WO | WO-2005069683 | A1 | 7/2005 |
| WO | WO-2005079373 | A2 | 9/2005 |
| WO | WO-2007069889 | A2 | 6/2007 |
| WO | WO-2008010716 | A2 | 1/2008 |
| WO | WO-2008105661 | A1 | 9/2008 |
| WO | WO-2009148311 | A2 | 12/2009 |
| WO | WO-2010074579 | A2 | 7/2010 |
| WO | WO-2012048232 | A2 | 4/2012 |

OTHER PUBLICATIONS

"U.S. Appl. No. 12/982,215, Preliminary Amendment mailed Mar. 18, 2011", 3 pgs.

"U.S. Appl. No. 12/982,267, Preliminary Amendment mailed Mar. 10, 2011", 3 pgs.

"U.S. Appl. No. 12/982,267, Response filed May 6, 2013 to Non Final Office Action mailed Dec. 4, 2012", 12 pgs.

(56) References Cited

OTHER PUBLICATIONS

"International Application Serial No. PCT/US2011/055384, International Preliminary Report on Patentability mailed Apr. 18, 2013", 23 pgs.
U.S. Appl. No. 12/982,215, Non Final Office Action mailed Nov. 29, 2012, 17 pgs.
U.S. Appl. No. 12/982,267, Non Final Office Action mailed Dec. 4, 2012, 17 pgs.
International Application Serial No. PCT/US2011/055384, Invitation to Pay Additional Fees mailed Feb. 9, 2012, 8 pgs.
International Application Serial No. PCT/US2011/055384, Search Report mailed May 15, 2012, 9 pgs.
International Application Serial No. PCT/US2011/055384, Written Opinion mailed May 15, 2012, 23 pgs.
Ghent, Jr., Robert M., et al., "Clinical Outcomes with an Instant-Fit DSP Hearing Aid", Sonic Innocations, vol. 4 No. 7, (2001), 4 pgs.
Schroeder, A, et al., "Let's get "AMPED": Concept and Design of a Non-Custom CIC", XP002674868, Retrieved from the Internet: http://www.starkeypro.com/public/pdfs/technical-Paper.pdf on Apr. 26, 2012, (Jan. 1, 2011), 7 pgs.
"U.S. Appl. No. 12/982,215, Final Office Action mailed Sep. 19, 2013", 23 pgs.
"U.S. Appl. No. 12/982,267 , Response filed Nov. 13, 2013 to Final Office Action mailed Sep. 13, 2013", 12 pgs.
"U.S. Appl. No. 12/982,267, Final Office Action mailed Sep. 13, 2013", 23 pgs.
"U.S. Appl. No. 12/982,267, Notice of Allowance mailed Nov. 22, 2013", 13 pgs.
"U.S. Appl. No. 12/982,215 , Response filed Dec. 19, 2013 to Final Office Action mailed Sep. 19, 2013", 14 pgs.
"U.S. Appl. No. 12/982,215, Non Final Office Action mailed Jan. 14, 2014", 24 pgs.
"U.S. Appl. No. 12/982,215, Notice of Allowance mailed May 28, 2014", 12 pgs.
"U.S. Appl. No. 12/982,215, Response filed Apr. 14, 2014 to Non Final Office Action mailed Jan. 14, 2014", 16 pgs.
"Japanese Application Serial No. 2013-532978, Office Action mailed May 28, 2014", 2 pgs.
"User Manual: Philips Microlux hearing capsule HC8900", (2006), 32 pgs.

* cited by examiner

HOUSING FOR A STANDARD FIT HEARING ASSISTANCE DEVICE

CLAIM OF PRIORITY

The present application claims the benefit under 35 U.S.C. §119(e) of U.S. Provisional Patent Application Ser. No. 61/391,521, filed on Oct. 8, 2010, which is incorporated herein by reference in its entirety.

This application is related to co-pending, commonly assigned, U.S. patent application Ser. No. 12/982,215, entitled "STANDARD FIT HEARING ASSISTANCE DEVICE WITH REMOVABLE SLEEVE", filed on Dec. 30, 2010, and U.S. patent application Ser. No. 12/982,267, entitled "ADJUSTMENT AND CLEANING TOOL FOR A HEARING ASSISTANCE DEVICE", filed on Dec. 30, 2010, which are hereby incorporated by reference in their entirety.

TECHNICAL FIELD

This document relates generally to hearing assistance systems and more particularly to a hearing aid assembly including a standard fit completely in the canal hearing aid.

BACKGROUND

Hearing aids are used to assist patient's suffering hearing loss by transmitting amplified sounds to ear canals. In one example, a hearing aid is worn in and/or around a patient's ear. Patients prefer that their hearing aids are minimally visible or invisible, do not interfere with their daily activities, and easy to maintain (such as removing earwax accumulation). However, due to the anatomical and audiological differences among patients, each hearing aid may need to be customized by a trained professional to be secured to the ear and to adequately restore the patient's hearing function.

One approach is to perform a custom fitting procedure that matches the device to a patient's ear canal. This is typically performed using an earmold and modeling the device using the patient's earmold. This procedure alone requires multiple patient visits to take the mold and then to have the device fitted to the patient. Other standard fit devices may be employed that do not require the taking of impressions, but such devices, (for example, receiver-in-the-canal devices) are typically visible to others.

Thus, there is a need for reducing size, the visits to a hearing professional, and maintenance requirements for hearing aids.

SUMMARY

A hearing aid kit includes a standard fit completely-in-canal (CIC) hearing aid and a hearing aid tool set. The CIC hearing aid is for extended use and includes a core module inserted into a sleeve. The core module and the sleeve each include various features providing for a minimum overall size, ease of insertion, removal, and cleaning, and enhanced sound transmission. The tool set is designed for easy carrying and storage by a user wearing the present hearing aid. In one example, the directions of the microphone and receiver are approximately perpendicular to each other for reducing overall length and vibration of the hearing aid, while the microphone has its direction pointing toward the aperture of the ear canal. In another example, the amplified sound is transmitted to an ear canal though receiver ports in the core module and the sleeve that are remote from each other and connected through an acoustic channel to increase the acoustic bandwidth. In another example, the tool set is configured to be stored and carried in a single piece and provides for adjustment and cleaning of the present hearing aid.

In one embodiment, a hearing aid includes a hearing aid circuit and a case. The hearing aid circuit includes a microphone, a receiver, and a processor circuit coupled between the microphone and the receiver. The case houses the hearing aid circuit and includes a base structure. The base structure is a continuous wall structure that includes a rear portion, a front portion, and a middle portion. The rear portion houses at least the microphone and has a first opening. The front portion houses at least the receiver and has a second opening. The middle portion is configured to hold a battery. The first opening and the second opening are on planes that are approximately perpendicular to each other.

In one embodiment, a hearing aid includes a microphone and processor module, a receiver module, and a case. The microphone and processor module includes a microphone and at least a portion of a processor circuit including a digital signal processor (DSP). The receiver module includes at least a receiver. The case includes a base structure being a continuous wall structure that includes a microphone and DSP compartment housing the microphone and processor module, a receiver compartment housing the receiver module, and a battery compartment coupled between the microphone and DSP compartment and the receiver compartment.

In one embodiment, a hearing aid includes a core module and a soft sleeve. The core module includes a hearing aid circuit and a case housing the hearing aid circuit. The hearing aid circuit includes a receiver. The soft sleeve accommodates at least a portion of the core module. The sleeve includes a wall and a receiver port on the wall. The receiver port provides for transmission of sound from the receiver and includes a plurality of boomerang ports.

In one embodiment, a hearing aid includes a core module and a sleeve. The core module includes a hearing aid circuit and a case housing the hearing aid circuit. The hearing aid circuit including a receiver. The sleeve is configured to accommodate at least a portion of the core module. It includes a front end, an opposite open rear end, and a wall. The front end includes a sound slit or sound hole for transmission of sound from the receiver. The rear end includes an opening allowing for insertion of the core module into the sleeve. The wall has an interior surface including retention ribs to keep the core module embedded in the sleeve.

In one embodiment, a method for providing a hearing aid for deep insertion into a wearer's ear canal is provided. A core module including a hearing aid circuit is provided. A plurality of sleeves is provided. The sleeves have different sizes and are each configured to accommodate at least a portion of the core module. A sleeve is selected from the plurality of sleeves according to a size of the wearer's ear canal. The core module is inserted into the selected sleeve.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance system including a standard fit, completely-in-canal hearing aid and a tool set provided to a patient wearing the hearing aid for easy maintenance and adjustments. The present hearing aid allows for deep insertion into an ear canal and extended use within the ear canal, and includes a core module and a sleeve into which a substantial portion of the core module is inserted before its use. As discussed in detail as follows, various features are provided to each of the core module and the sleeve to provide for a minimum overall size of the hearing aid, ease of insertion, removal, and cleaning, and enhanced sound transmission.

Figure 1:
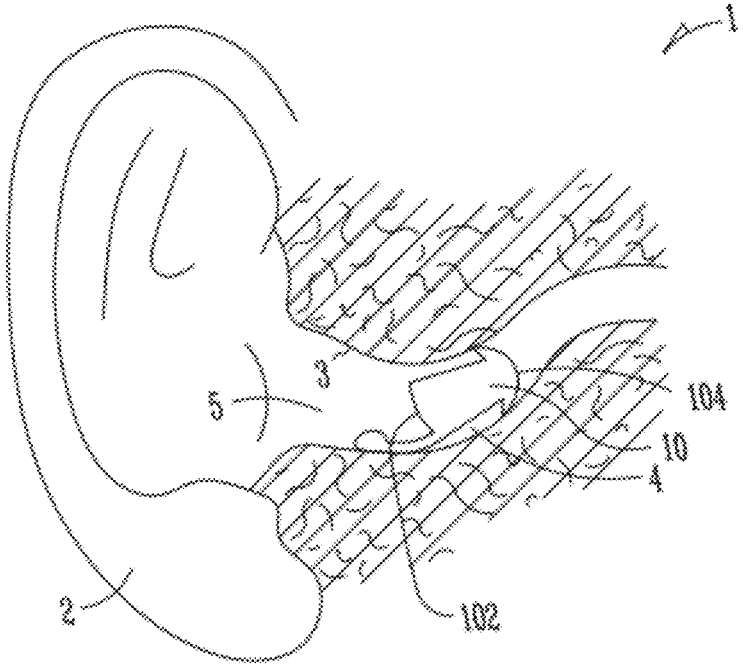
FIG. 1 is an illustration of an embodiment of a hearing aid and portions of an environment in which the hearing aid is used.

FIG. 1 is an illustration of an embodiment of a hearing aid 10 and portions of an environment in which hearing aid 10 is used. Hearing aid 10 is a standard fit, CIC hearing aid providing reduced visibility after being properly inserted in an ear canal. As illustrated, an ear 1 includes a pinna 2 and an ear canal 3, and hearing aid is placed in ear canal 3. In one embodiment, hearing aid 10 is shaped for placement at or just past a first bend 4, as past an aperture 5, of ear canal 3.

Hearing aid 10 has a rear end 102 and a front end 104. Front end 104 enters ear canal 3 first when hearing aid 10 is being inserted for its intended use. In one embodiment, hearing aid 10 is tapered, with front end 104 being smaller (e.g., has a smaller diameter) than rear end 102, for ease of insertion.

Figure 2:
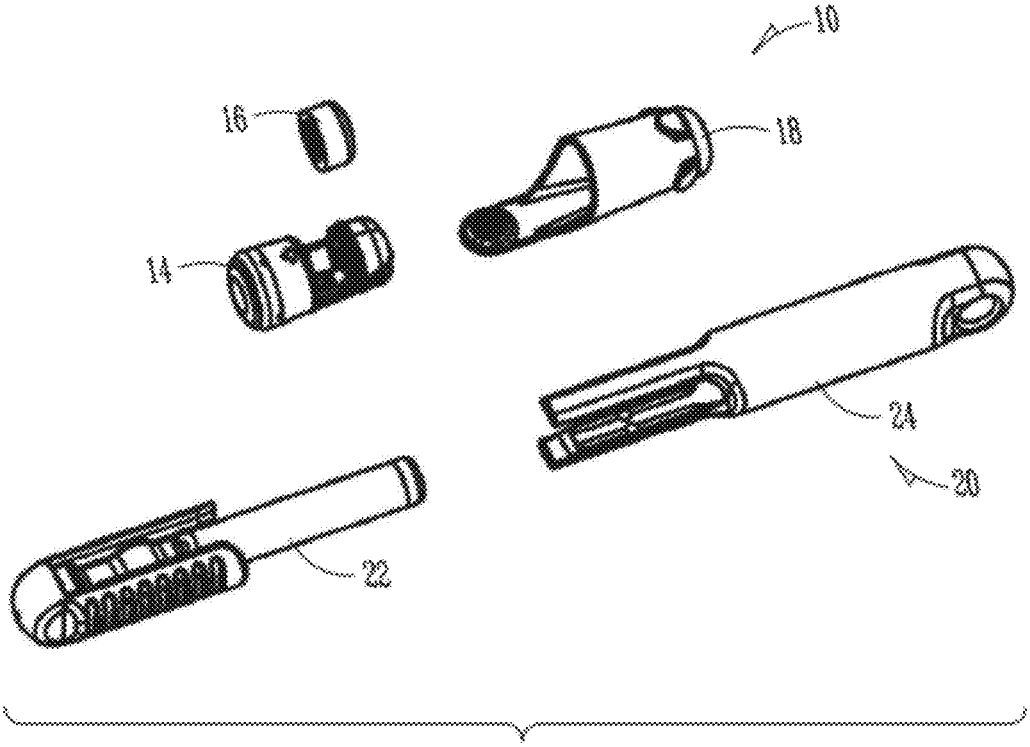
FIG. 2 is an illustration of an embodiment of a hearing aid kit.

FIG. 2 is an illustration of an embodiment of a hearing aid kit including hearing aid 10 and a hearing aid tool set 20. Hearing aid 10 includes a core module 14, a battery 16 to be placed in core module 14, and a sleeve 18 shaped to accommodate at least a portion of core module 14 (with battery 16 inserted therein). In one embodiment, sleeve 18 is sized to allow a substantial portion of core module 14 (with battery 16) to be inserted. In one embodiment, sleeve 18 is sized to allow approximately the entire core module 14 (with battery 16) to be inserted, as illustrated in FIG. 3 with a sleeve 18A, which as discussed below is an embodiment of sleeve 18.

Hearing aid tool set 20 includes a magnetic wand 22 and a wand shield 24. Magnetic wand 22 allows a wearer to turn on and off hearing aid 10. In one embodiment, magnetic wand 22 further allows the wearer to cycle through various settings. In various embodiments, the wand is adapted to cycle through sound volume settings. In various embodiments, the wand is adapted to cycle through parameter selections. In various embodiments, the parameters include, but are not limited to, sound volume, frequency-based filtering, acoustic feedback cancellation modes, noise management modes, or combinations thereof. When not being used, magnetic wand 20 is partially inserted into wand shield 24 such that hearing aid tool set 20 becomes a single piece for storage and carrying purposes. Other wand packaging and configurations are possible without departing from the scope of the present subject matter.

Figure 3:
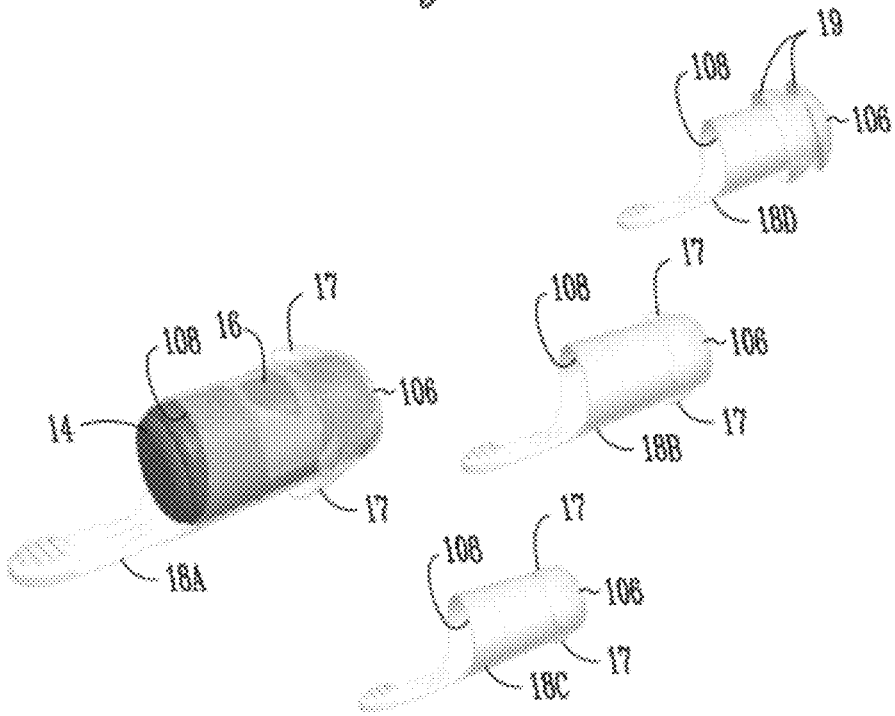
FIG. 3 is an illustration of various embodiments of a sleeve of the hearing aid.

FIG. 3 is an illustration of various embodiments of sleeve 18. Examples of sleeve 18 as shown include, but are not limited to, sleeves 18A-D. Sleeves 18A-C are sleeves of different sizes provided for selection according to the wearer's ear canal size. These sleeves are intended to provide an open fit which is a deep insertion into the wearer's ear canal. When properly configured, the sleeves provide an easy adjustment to overall device size that can accommodate most users. The sizes of sleeve 18A-C also determine how deep hearing aid 10 can be inserted into ear canal 3. In the illustrated embodiment, sleeve 18A is of large size, sleeve 18D is of medium size, and sleeve 18C is of small size. Sleeves 18A-C each include anchors 17 for securing hearing aid 10 in ear canal 3 without occluding ear canal 3 during use. Sleeve 18D includes flanges 19 providing for occlusion of ear canal 3. In the illustrated embodiment, flanges 19 includes "dish and bowl" flanges that create a precise occluded fit in varying ear canal anatomies.

In this document, "sleeve 18" represents any of the sleeves according to the present subject matter, including, but not limited to, sleeves 18A-D. The selection of a specific version of sleeve 18 depends on the wearer's ear canal anatomy and whether the ear canal is to be occluded during the use of hearing aid 10.

In various embodiments, sleeve 18 has a front end 106 which provides a sound slit or sound hole for the transmission of sound from a receiver mounted in the core module 14. Sleeve 18 includes an opposite open rear end 108 (as illustrated in FIG. 3 for each of sleeves 18A-D) including an opening allowing for insertion of core module 14 (with battery 16).

Ear canal 3 is about 25 mm in length. Tympanic membrane (ear drum) is about 9-10 mm in diameter. Sleeve 18 has a diameter of approximately 7 mm at front end 106 and approximately 9 mm at rear end 106, excluding anchors 17 or flanges 19. Such sizes allow hearing aid 10 to be placed at or just past first bend 4 of ear canal 3. In a specific embodiment, hearing aid 10 (with sleeve 18) has a diameter of approximately 8.25 mm or above at rear end 102 and about 6.7 mm at front end 104. Core module 14 has a diameter of approximately 7.4 mm or above at rear end 102 and about 6.1 mm at front end 104. These sizes are discussed by way of example, and not by way of limitation. In various embodiments, hearing aid 10 is shaped and sized according to various ear anatomies and intended location for placement in ear canal 3.

In various embodiments, sleeve 18 is made of a soft rubber material. In one embodiment, sleeve 18 is made of liquid injection molded (LIM) silicon rubber. In various embodiments, the sleeve is made of materials including, but not limited to transfer molded nitriles, elastomers, rubbers, buna nitriles, flurosilicones, plastic, silicone rubber, urethane, neoprene, nitrile/buna-n, gum natural, EPDM, and combinations thereof. Examples of characteristics of the material of which sleeve 18 is made include excellent tear strength, high tensile strength, weather ability, retention of durometer over temperatures, excellent strength and recovery properties, resistance to attack by chemical and organics, washable with mild detergent, and dishwasher safe (as a cleaning option). In one embodiment, LIM 6030 by GE (GE LIM 6030) may be used. In various embodiments, the sleeve 18 is adapted to snugly fit over the core module 14 and battery 16. One advantage of this approach is that the sleeve can be used and disposed of when worn, or dirty, or when it has lost its elasticity. The sleeve also has the benefit of providing a compliant surface which stays in place when seated in the ear canal.

Figure 4:
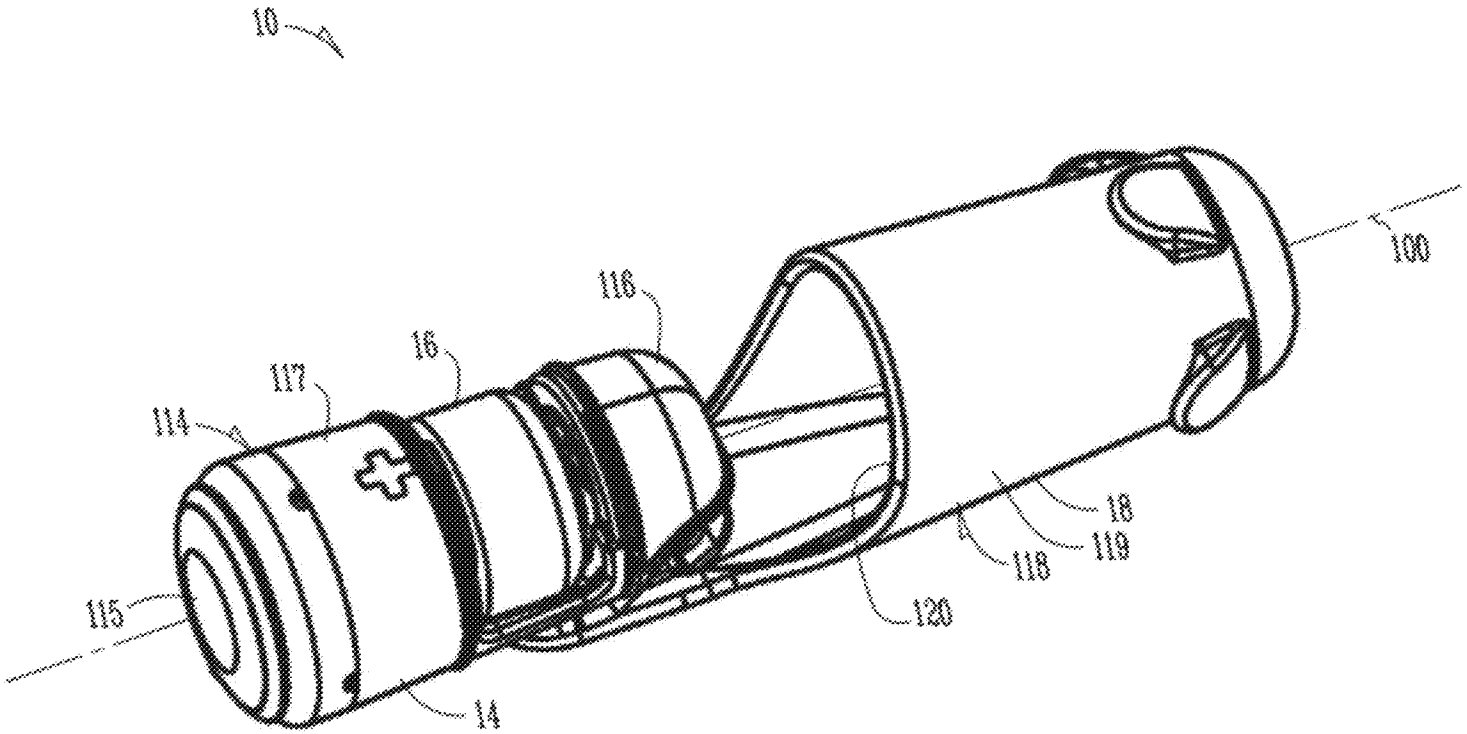
FIG. 4 is an illustration of an embodiment of the hearing aid showing a core module and the sleeve.

FIG. 4 is an illustration of an embodiment of hearing aid 10 showing core module 14 (with battery 16 inserted therein) and sleeve 18. Hearing aid 10 has a main axis 100. In the illustrated embodiments, core module 14 when inserted in sleeve 18 is approximately co-axial with sleeve 18 about main axis 100. Core module 14 includes an exterior surface 114, which includes a rear end surface 115, a front end surface 116, and a lateral surface 117. In the illustrated embodiment, rear end surface 115 and front end surface 116 are each approximately centered on main axis 100. Lateral surface 117 is coupled between rear end surface 115 and front end surface 116. Sleeve 18 includes a wall 118 that includes an exterior surface 119 and an interior surface 120. When core module 14 (with battery 16) is inserted into sleeve 18, a substantial portion of exterior surface 114 of core module 14 is in contact with a substantial portion of interior surface 120 of wall 118 of sleeve 18.

Figure 5:
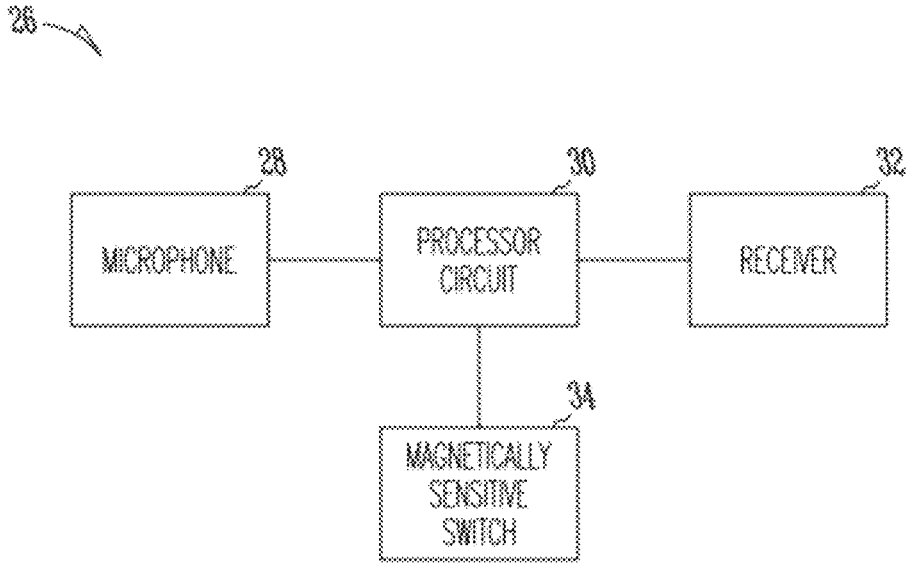
FIG. 5 is a block diagram showing an embodiment of a hearing aid circuit housed in the core module.

FIG. 5 is a block diagram showing an embodiment of a hearing aid circuit 26 housed in core module 14. Hearing aid circuit 26 is powered by battery 16 and includes a microphone 28, a receiver (speaker) 32, and a processor circuit 30 electrically connected to each of microphone 28 and receiver 32. Microphone 28 has a directionality determined by the orientation of its microphone diaphragm. Receiver 28 has a directionality determined by the orientation of its receiver diaphragm. In the illustrated embodiment, hearing aid circuit 26 also includes a magnetically sensitive switch 34 (examples include, but are not limited to, a reed switch, a hall effect sensor, a giant magnetoresistive sensor or GMR sensor, an anisotropic magnetoresistive or AMR sensor, or a tunneling magnetoresistive sensor or TMR sensor) that allows for switching or adjusting hearing aid circuit 26 in response to an external magnetic field. In one embodiment, magnetically sensitive switch 34 allows for cycling through various sound volume settings for hearing aid circuit 26 in response to the external magnet field. In one embodiment, magnetically sensitive switch 34 allows the wearer to cycle through various settings. In various embodiments, the system is adapted to cycle through sound volume settings. In various embodiments, the system is adapted to cycle through parameter selections. In various embodiments, the parameters include, but are not limited to, sound volume, frequency-based filtering, acoustic feedback cancellation modes, noise management modes, or combinations thereof. In one application, the external magnet field is created by magnetic wand 22. In other applications other magnetic field generators may be used.

Figure 6:
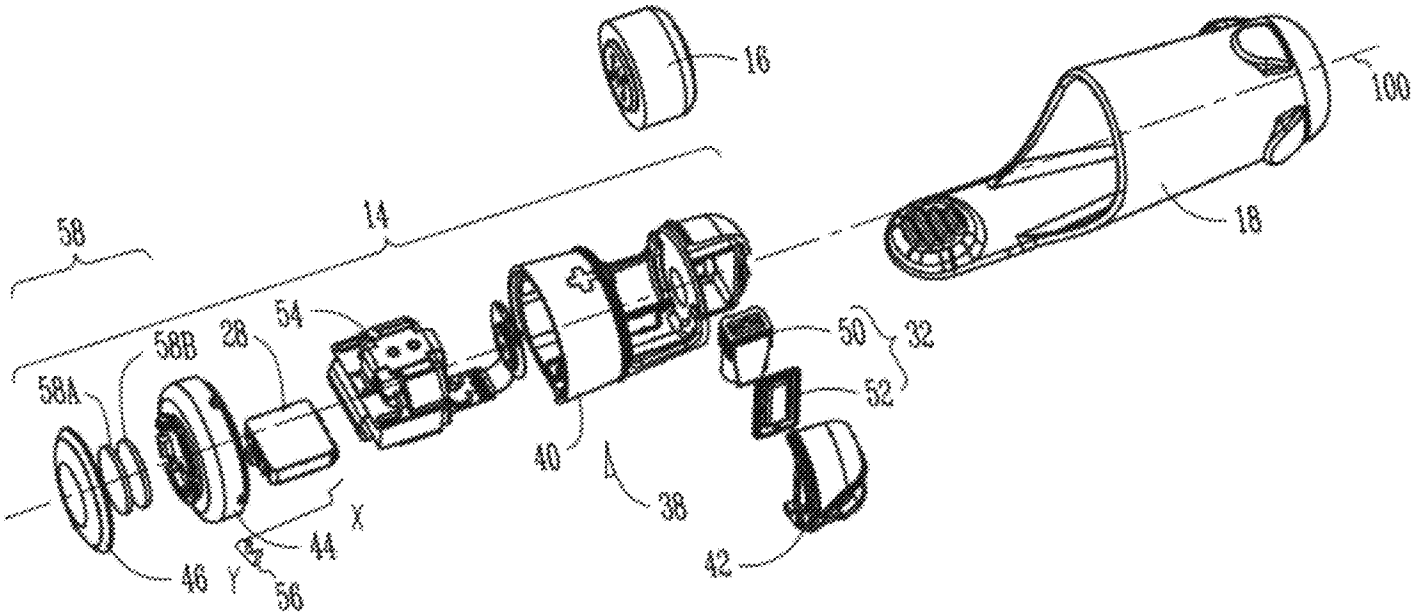
FIG. 6 is an assembly diagram illustrating an embodiment of an assembly of components of the hearing aid.

FIG. 6 is an assembly diagram illustrating an embodiment of an assembly of components of hearing aid 10 showing sleeve 18, components of core module 14, and battery 16. The components of core module 14 include a case 38, a receiver module 48, a microphone and processor module 54, litz wires 56, and a filter set 58. Case 38 includes a base structure 40, an end cap 44, a snap cap 46, and a receiver lid 42. Microphone and processor module 54 includes a microphone 28. Receiver module 48 includes at least receiver 32. Processor circuit 30 is distributed in either one or both of microphone and processor module 54 and receiver module 48. In the illustrated embodiment, a major portion, or approximately the entirety of, processor circuit 30 is included in microphone and processor module 54. In the illustrated embodiment, receiver module 48 includes receiver motor 50 and receiver diaphragm 52. In various embodiments, by compartmentalizing receiver 32 separate from microphone 28 the acoustic separation between the receiver and the microphone is enhanced. Orientation and motion of receiver diaphragm 52 is orthogonal to the orientation and motion of the microphone diaphragm of microphone 28. This reduces mechanical coupling, and therefore microphone 28 picks up less vibration from receiver 32. In the illustrated embodiment, components of hearing aid 10 including sleeve 18, base structure 40, battery 16, microphone and processor module 54, end cap 44, filter set 58, and snap cap 46 are coaxially assembled about main axis 100.

Figure 7A:
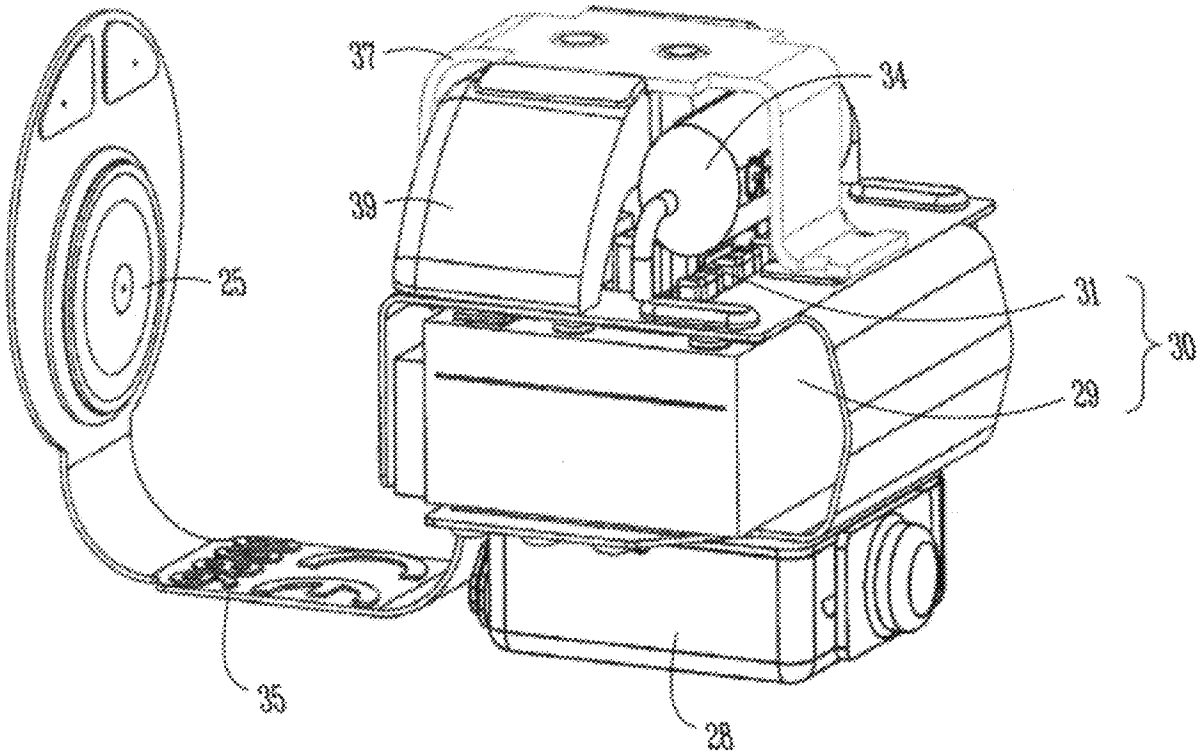
FIGS. 7A-B are illustrations of an embodiment of a microphone and processor module.
Figure 7B:
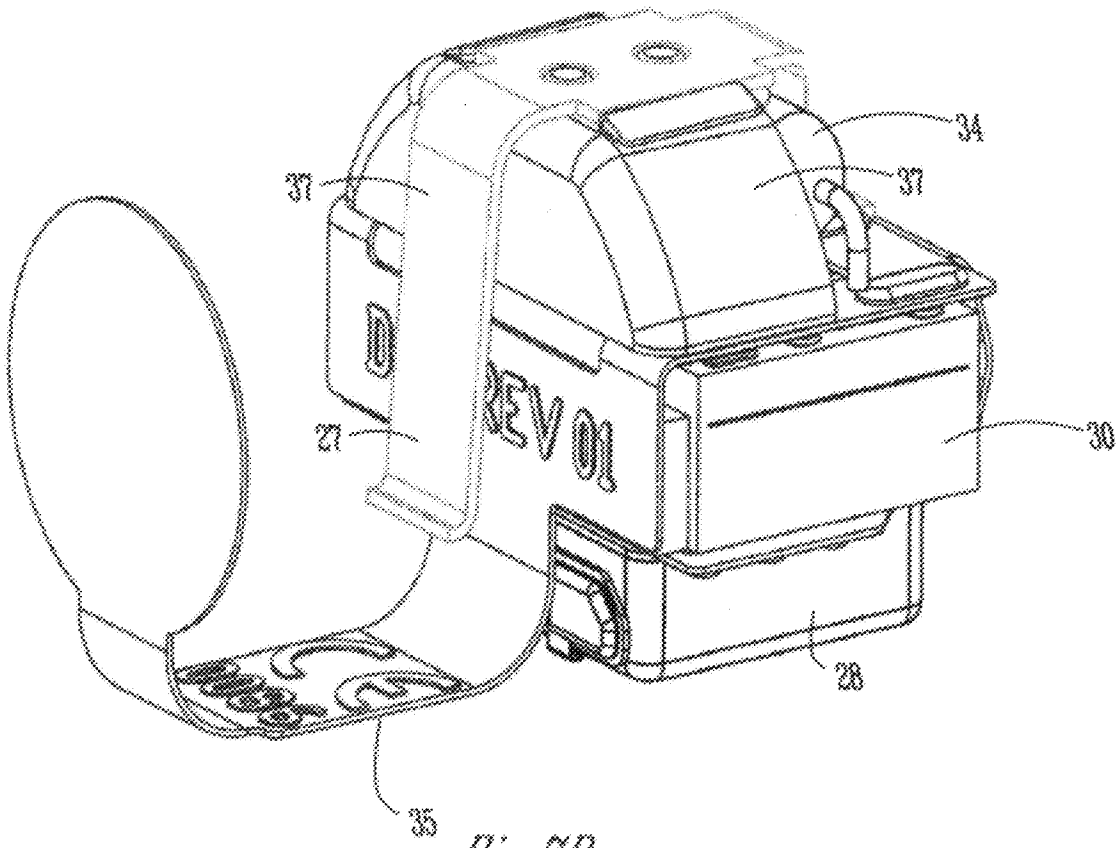

FIGS. 7A-B are illustrations of an embodiment of microphone and processor module 54. In the illustrated embodiment, microphone and processor module 54 includes microphone 28, magnetically sensitive switch 34, and processor circuit 30, which includes a digital signal processor (DSP) 29 and supporting circuitry 31. In various embodiments, microphone and processor module 54 also includes a structure providing a tactile "snap" for mechanically and electrically connecting battery 16 to hearing aid circuit 26. A positive contact 37 which has a lip on a positive terminal 27 is mounted to a standoff 39 by bonding. Positive contact 37 is made of stainless steel and gold plated, and is soldered to a flextape 35. It has a lever action that provides the tactile snap when battery 16 is inserted correctly. The positive contact of battery 16 is the planar portion (not the button portion) and when that is turned around the button (negative contact) will not engage. Litz wires 56 connect flex tape to receiver 32. Point Y is where Litz wires 56 are connected to flextape 35 and therefore DSP 29, which is the digital signal processor of processor circuit 30. Point X are Litz wires 56 running through the housing to receiver 32 where they are hard wired or soldered to receiver 32.

Figure 8:
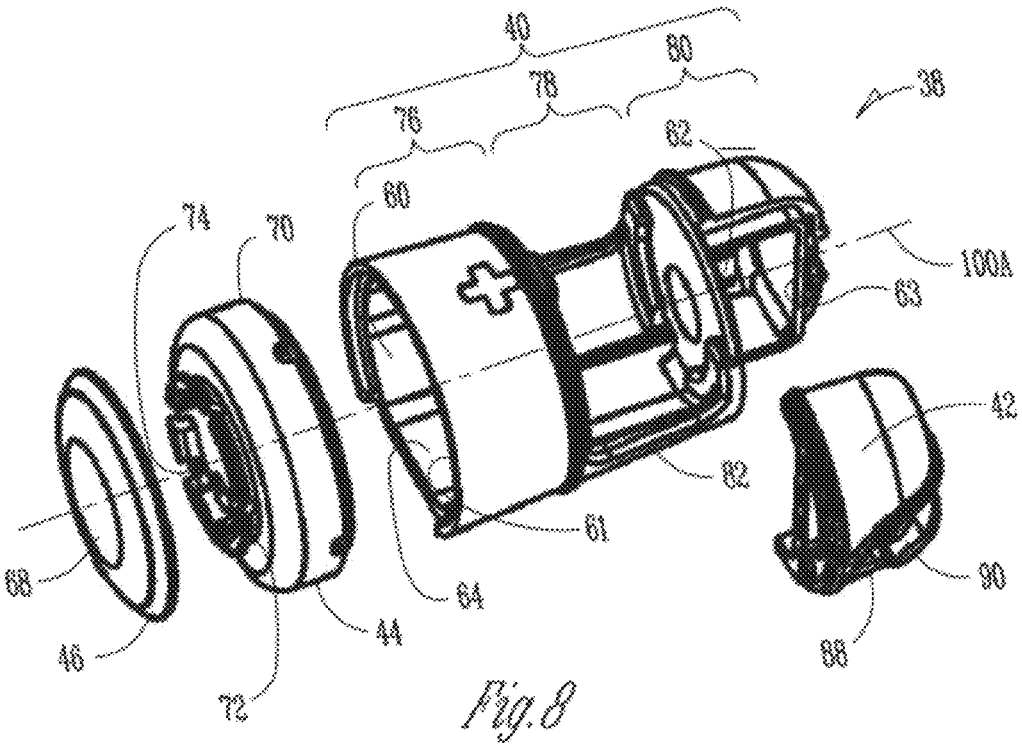
FIG. 8 is an assembly diagram illustrating an embodiment of an assembly of components of a case of the core module.

FIG. 8 is an assembly diagram illustrating an embodiment of an assembly of components of case 38. Case 38 includes a base structure 40, an end cap 44, a snap cap 46, and a receiver lid 42 to house hearing aid circuit 26 and generally defines the shape of core module 14, with its exterior surface being exterior surface 114 of core module 14. In one embodiment, case 38 is injection molded and made of a plastic material. Examples of some characteristics of such plastic material may include dimensional stability, low water absorption, good elasticity and high flexural fatigue, high strength, free of plasticizers, resistance to scratch, resistance to chemicals and stress cracking, high impact strength, suitable for laser marking, and very good processing characteristics including flowability (allowing for forming of thin wall sections and small parts). In one embodiment, the plastic material is a nylon material. One example of the nylon material is a nylon 12 material such as Grilamid® TR55 LX. Other materials may be used, including, but not limited to, polymers, plastics, rigid rubbers, castable materials, and elastomeric housings. Rigid materials also provide for reliable battery contacts. Case 38 has an axis 100A. In one embodiment, axis 100A becomes main axis 100 after hearing aid 10 is assembled. In one embodiment, case 38 is made as a unitary portion (also referred to as a continuous wall structure in this document) and not in halves to increase structural rigidity.

In various embodiments, base structure 40 is a continuous wall structure and includes a rear portion 76 (also referred to as the microphone and DSP compartment), a front portion 80 (also referred as the receiver compartment), and a middle portion 78 (referred to as the battery compartment) coupled between rear portion 76 and front portion 80. In one embodiment, the wall structure has an average of 0.020-inch thickness. Rear portion 76 includes a rear cavity 60 and a rear cavity opening 61. Rear cavity 60 is shaped to house microphone and processor module 54, which includes microphone 28, DSP 29 and supporting circuitry 31. The surface of rear cavity 60 includes molded-in guides using which microphone and processor module 54 is slid into its position within case 38. Rear cavity opening 60 is on a plane perpendicular to core axis 100A. In one embodiment, components of microphone and processor module 54 are arranged such that when it is housed in rear cavity 60, the microphone 28 is positioned such that the microphone diaphragm is approximately perpendicular to core axis 100A. In other words, microphone 28 is positioned such that its direction is approximately parallel to core axis 100 and points to rear end 102 of hearing aid 10. In one embodiment, microphone 28 is attached to rear portion 76 of base structure 40 using silicone bonding and Litz wire. In one embodiment, rear cavity 60 is filled with epoxy after microphone and processor module 54 is housed. In other embodiments, rear cavity 60 is not filled with epoxy.

Front portion 80 includes a front cavity 62 and a front cavity opening 63 exposing front cavity 62. Front cavity 62 is shaped to house receiver module 48. Front cavity opening 63 is approximately on a plane parallel to core axis 100A. In one embodiment, components of receiver module 48 are arranged such that when it is housed in front cavity 62, receiver 32 is positioned such that receiver diaphragm 52 is approximately parallel to core axis 100A. In other words, receiver 32 is positioned such that its direction is approximately perpendicular to core axis 100A and points away from core axis 100A. Such a receiver orientation allows for a shorter core module 14. Thus, the receiver diaphragm and the microphone diaphragm are approximately perpendicular to each other, thereby minimizing vibration of hearing aid 10 during operation. In other words, when both housed in case 38, microphone 28 and receiver 32 have directions approximately perpendicular to each other.

Middle portion 78 connects rear portion 76 and front portion 78 and forms a battery cradle 82 to hold battery 16. In one embodiment, battery 16 is a 10A zinc air button battery. Battery cradle 82 is coupled between two substantially parallel walls being a portion of the exterior surface of rear portion 76 and a portion of the external surface of front portion 80. Both of these external surfaces are approximately perpendicular to core axis 100A, and thus approximately parallel to each other. Rear portion 76, middle portion 78, and front portion 80 are so arranged to maximize the separation between microphone 28 and receiver 32, thereby providing for greater sound output while minimizing acoustic feedback.

End cap 44 includes a base ring 70 and a neck ring 72 coaxially connected to each other. Base ring 70 is bonded to base structure 40 at rear cavity opening 61 using moisture cure adhesive. Neck ring 72 including one or more microphone ports 74 that allow air and sound to pass through. In one embodiment, one or more microphone ports 74 include a plurality of radial ports to create a redundancy of sound inlets. In a specific embodiment, one or more microphone ports 74 include approximately 5 radial ports. Other numbers of ports may be used without departing from the scope of the present subject matter. Neck ring 72 is sized to accommodate filter set 58 as illustrated in FIG. 6. In various embodiments, the one or more filters include a hydrophobic and oleophobic random weave filter. In various embodiments, such a filter is made by die cut of nylon based filter media that provide for excellent air and acoustic flow while being hydrophobic and oleophobic. In one embodiment, the oleophobic rating of such a filter is 8 on oleophobic scale 1-8. Filter set 58 has a cross-sectional thickness that, when placed in neck ring 72, allows air and sound to enter its perimeter through the one or more microphone ports 74. In a specific embodiment, as illustrated in FIG. 6, filter set 58 includes two hydrophobic and oleophobic random weave filters. Thus, in some embodiments, the arrangement of filters and other components creates a three-dimensional filter media.

Snap cap 46 seats on end cap 46 over filter set 58 and neck ring 72 and has a surface at rear end 115 of case 38 that forms a back face 68 of case 38. Back face 68 is free of inlets and used as a plane to press against during insertion of hearing aid 10 into ear canal 3. This provides an advantage over microphone inlets on a back face that is known to associate with earwax clogging. Snap cap 46 is non-re-enterable keyed.

Receiver lid 42 is bonded to front portion 80 of base structure 40 over front cavity opening 63 to close front cavity 62. Receiver lid 42 includes a receiver port 88 such that receiver port 88 is on lateral surface 117 of exterior surface 114. In one embodiment, end cap 44, snap cap 46, and/or receiver lid 42 include 0.01-inch alignment ribs for alignment of base structure 40.

As further discussed below, a channel or groove 90 formed in receiver lid 42 is used to provide an acoustic passage for transmission of sound by receiver 32 through a receiver port 88. Receiver port 88 includes an off-axis opening in the wall of receiver lid 42. Channel or groove 90 is adapted to provide enhanced bandwidth of sounds played from receiver 32 which are ultimately passed through openings at front end 106 of sleeve 18. Additionally, this off-axis exit from receiver 32 affords an open channel for cleaning of wax before it can enter receiver 32. The process includes removal of sleeve 18 and cleaning of the channel or groove if needed to avoid wax buildup and wax entry into the receiver mechanism.

Figure 9:
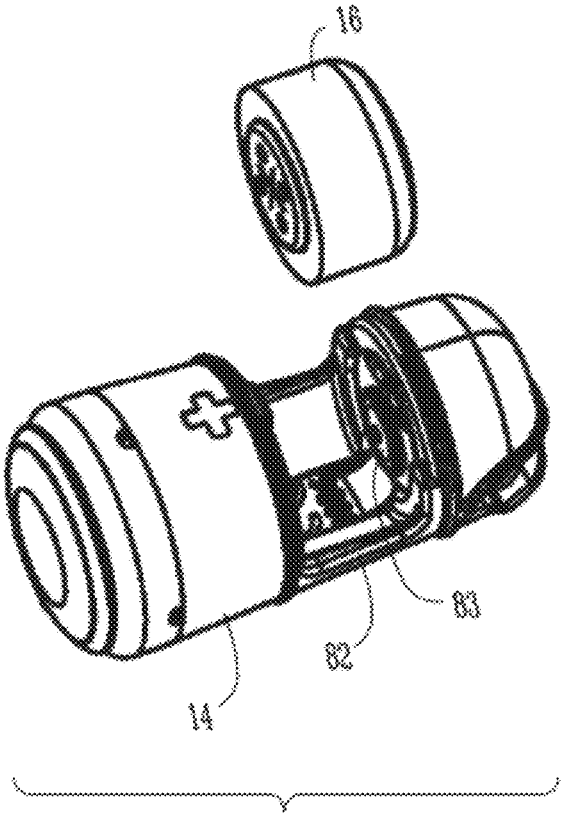
FIG. 9 is an illustration of an embodiment the core module and a battery.

FIG. 9 is an illustration of an embodiment of core module 14 and battery 16. A tactile snap 83, which is part of microphone and processor module 54 and attached to the exterior surface of front portion 80, provides for a secure placement of battery 16 in battery cradle 82 of core module 14 while providing for a confirmation that battery 16 is inserted in proper orientation. When battery 16 is inserted in the proper orientation, a definite tactile snap is heard and felt. An improper insertion of battery 16 (e.g., incorrect polarity) results in little or no snap or tactile response, and hearing aid circuit 26 is not powered to operate.

Figure 10:
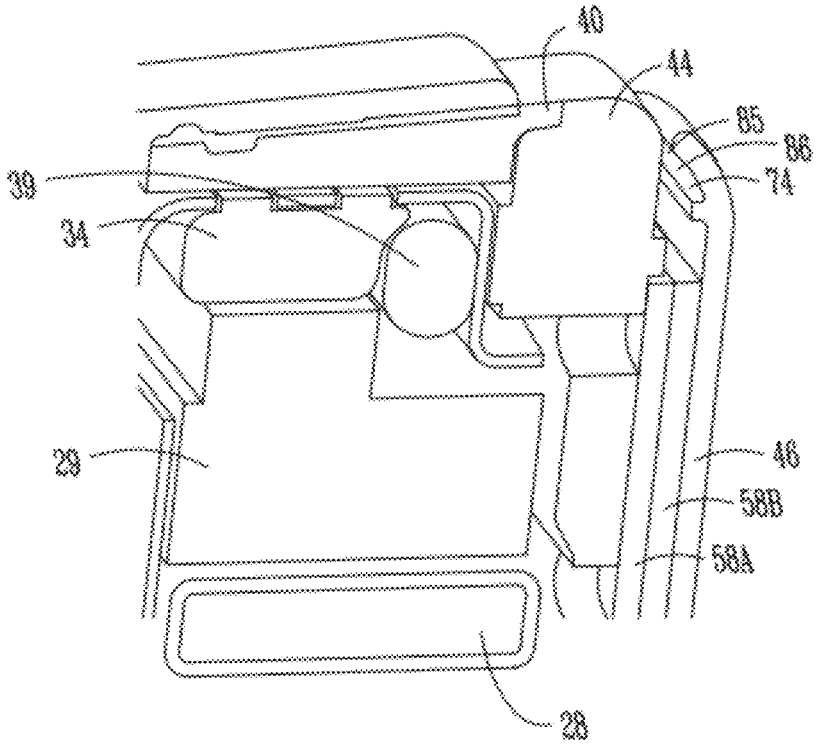
FIG. 10 is a cross-sectional view illustrating an embodiment of a rear portion of the core module.

FIG. 10 is a cross-sectional view illustrating an embodiment of a rear portion of core module 14. Snap cap 46 when seating on end cap 44 creates a slit 85 having a 360-degree perimeter between snap cap 46 and end cap 44 that functions as an inlet port for sound and air leading to microphone port(s) 74. Slit 85 protects the ingress path for the air and sound during assembly and insertion of hearing aid 10 into ear canal 3. A collection chamber 86 formed between snap cap 46 and end cap 44 adjacent slit 85 collects earwax. The collected earwax can then be removed without damaging filter set 58. The unique mesh of filter set 58 allows air and sound to pass through the perimeter of the one or more filters.

Figure 11:
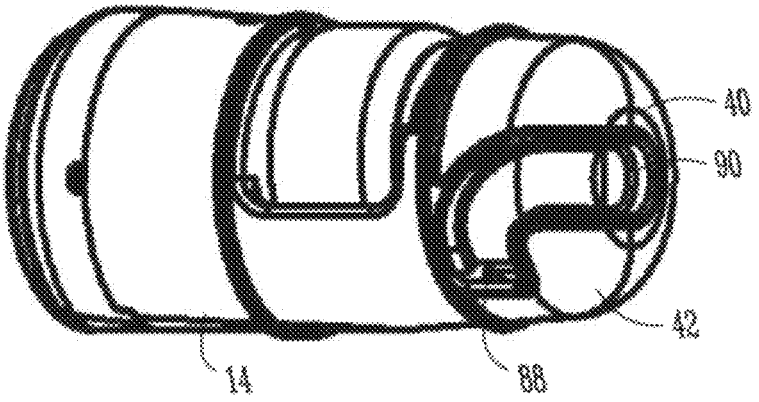
FIG. 11 is an illustration of an embodiment of the core module showing a receiver port and an acoustic channel.

FIG. 11 is an illustration of an embodiment of core module 14 showing receiver port 88 and acoustic channel 90. Receiver port 88 includes an opening on receiver lid 42 providing for acoustic access to receiver 32. In the illustrated embodiment, receiver port 88 includes an opening on exterior surface 114 of case 38. Acoustic channel 90 is a curved acoustic channel formed on exterior surface 114 of case 38 to transmit the sound from receiver port 88 to a receiver port on sleeve 18. After core module 14 is inserted into sleeve 18, acoustic channel 90 provides for the acoustic path through which sound is transmitted from receiver 32 to ear canal 3. Compared to a receiver port with a shorter acoustic path, this acoustic path provides for a width acoustic bandwidth. In one embodiment, acoustic channel 90 has a length determined by a desirable acoustic bandwidth. In one embodiment, acoustic channel 90 is also shaped to allow easy cleaning of earwax to prevent receiver port 88 from being plugged.

In various embodiments, acoustic channel 90 is formed on at least the exterior surface of receiver lid 42. In one embodiment, acoustic channel 90 is formed on the exterior surface of receiver lid 42 and exterior surface 114 of base structure 40 at front end 116. Acoustic channel 90 has a first end at receiver port 88 and a second end on or near core axis 100A.

Figure 12:
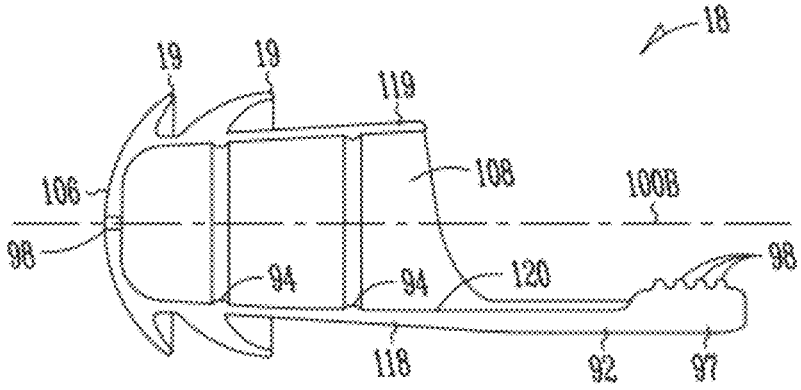
FIG. 12 is a cross-sectional view illustrating an embodiment of the sleeve.

FIG. 12 is a cross-sectional view illustrating an embodiment of sleeve 18. Sleeve 18 includes a sleeve axis 100B. In one embodiment, when core module 14 is inserted into sleeved 18, sleeve axis 100B and core axis 100A approximately become a common axis. In other words, sleeve 18 and core module 14 are coaxial about main axis 100 of hearing aid 10. Sleeve 18 conforms around core module 14 to provide a friction fit and a cushion to the wearer's ear canal.

Sleeve 18 includes a removal strand 92 being a structure continuous from wall 118. Strand 92 allows for removal of hearing aid 10 from ear canal 3 by pulling its handle 97. Handle 97 includes raised bulbs 98 providing for tactile locator in ear canal 3 and providing for positive grip of removal strand 92 for ease of removal.

As illustrated in FIG. 12, wall 118 of sleeve 18 has interior surface 120 forming a cavity accommodating at least a portion of core module 14 and an opposite exterior surface 119. In one embodiment, interior surface 120 includes retention ribs 94 to keep core module 14 embedded in sleeve 18.

In the embodiment as illustrated in FIG. 12, sleeve 18 includes flanges 19 on exterior wall 119 to create unobstructed open fit in ear canal 3. Flanges 19 are sized to fit in and not to occlude the ear canal.

Figure 13:
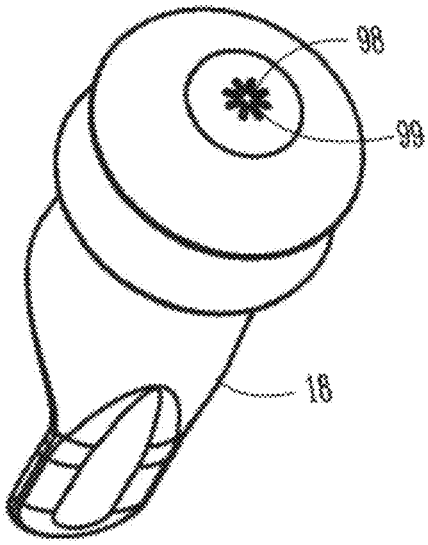
FIG. 13 is an illustration of an embodiment of the sleeve showing a receiver port.
Figure 14:
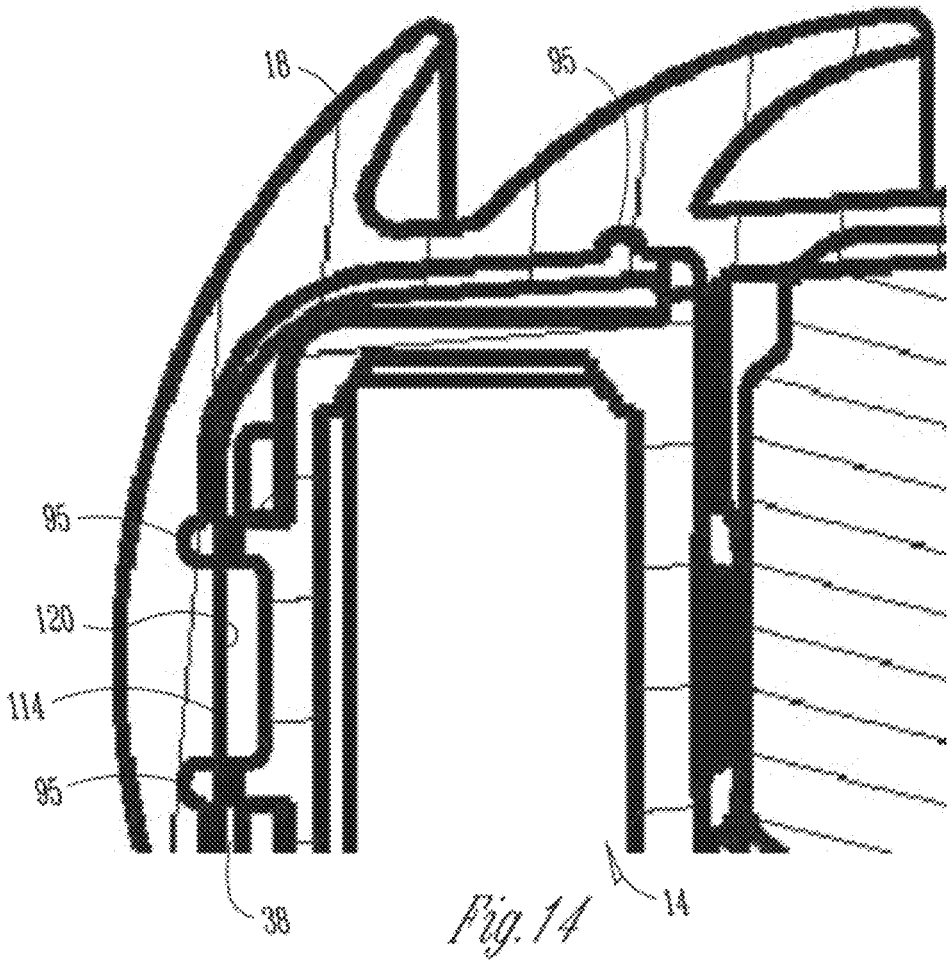
FIG. 14 is a cross-sectional view illustrating an embodiment of a front portion of the hearing aid.

FIG. 13 is an illustration of an embodiment of sleeve 18 showing a receiver port 98. Receiver port 98 is at closed front end 106 of sleeve 18 and is positioned to be over the second end of acoustic channel 90 on core module 14. In one embodiment, receiver port 98 is on axis. In one embodiment, receiver port 98 includes a plurality of boomerang ports to create a redundant open acoustic path for receiver 32 while flaps 99 present a barrier for earwax during insertion of hearing aid 10 into canal 3. In one embodiment, receiver port 98 includes 2 boomerang ports. In another embodiment, receiver port 98 includes 4 boomerang ports. Other numbers and shapes of ports may be used without departing from the scope of the present subject matter. The flaps of the boomerang ports also allow for easy cleaning with common tools, FIG. 14 is a cross-sectional view illustrating an embodiment of a front portion of hearing aid 10 showing case 40 of core module 14 and sleeve 18. In the illustrated embodiment, exterior surface 114 of case 38 includes raised ribs 95 that create an acoustic and environmental seal between exterior surface 114 of core module 14 and interior surface 120 of sleeve 18.

Figure 15:
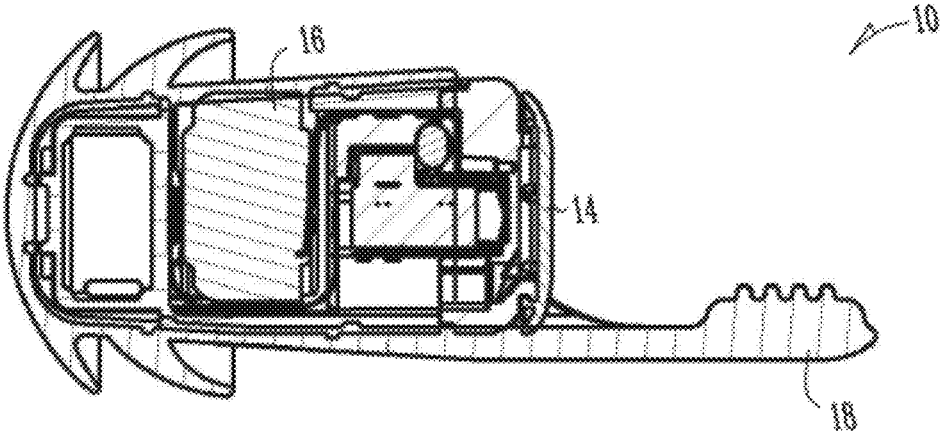
FIG. 15 is a cross-sectional view illustrating an embodiment of the hearing aid that is assembled for use.

FIG. 15 is a cross-sectional view illustrating an embodiment of hearing aid 10 that is assembled for use. In one embodiment, hearing aid 10 is tapered for ease of insertion past the first bend in ear canal 3. In one embodiment, both core module 14 and sleeve 18 are tapered. In another embodiment, core module 14 is substantially cylindrical while sleeve 18 is tapered.

In one embodiment, core module 14 has a length of approximately 14.55 mm, and sleeve 18 has a length of approximately 24.55 mm with strand 92 and approximately 15.1 mm without strand 92.

Figure 16:
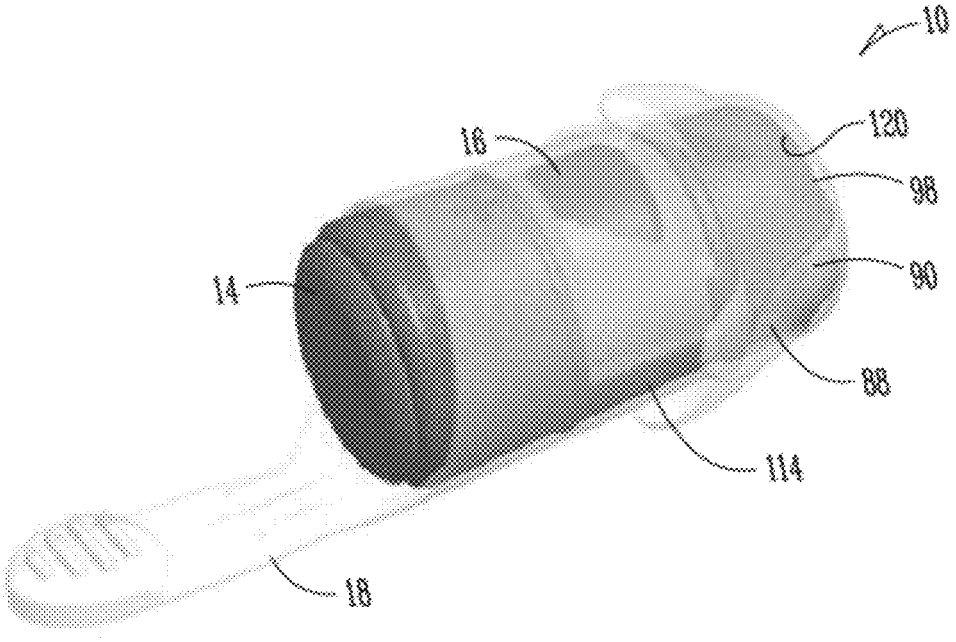
FIG. 16 is an illustration of an embodiment of the hearing aid that is assembled for use.

FIG. 16 is an illustration an embodiment of hearing aid 10 that is assembled for use. As shown in FIG. 16, acoustic channels 90 formed on exterior surface 114 of core module 14 (and between exterior surface 114 of core module 14 and interior surface 120 of sleeve 18) provides for the acoustic path between receiver port 88 of core module 14 and receiver port 98 of sleeve 18.

In various embodiments, hearing aid 10 is a tapered (and not bent or angled) standard fit, totally integrated stock CIC hearing aid. In one embodiment, hearing aid 10 is non-occlusive by selecting a version of sleeve 18 that is shaped and sized not to occlude ear canal 3. In another embodiment, hearing aid 10 is non-occlusive by selecting a version of sleeve 18 that is shaped and sized to occlude ear canal 3.

Figure 17:
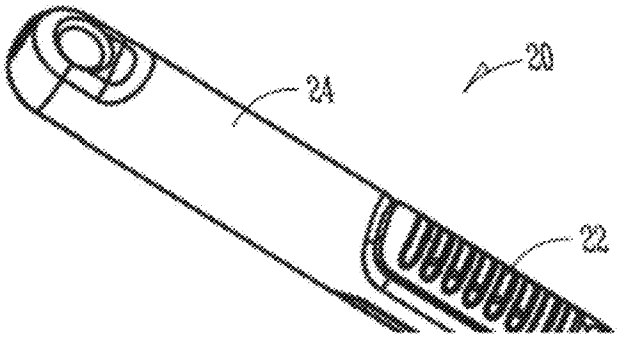
FIG. 17 is an illustration of an embodiment of the hearing aid tool set showing a magnetic wand inserted in a wand shield.
Figure 18:
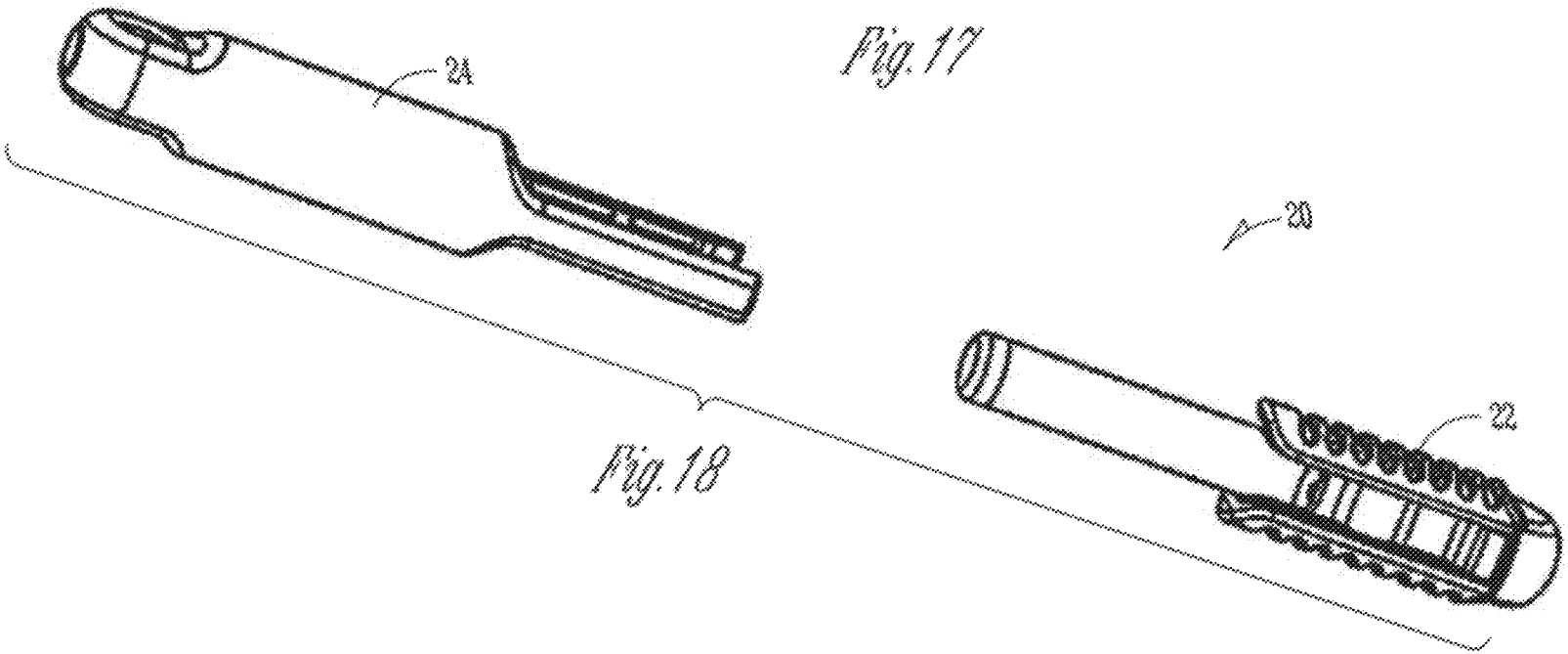
FIG. 18 is an illustration of an embodiment of the hearing aid tool set showing the magnetic wand separated from the wand shield.

FIG. 17 is an illustration of an embodiment of hearing aid tool set 20 showing magnetic wand 22 partially inserted in wand shield 24 such that hearing aid tool set becomes a single piece for storage and/or carrying. FIG. 18 is an illustration of an embodiment of hearing aid tool set 20 showing magnetic wand 22 separated from wand shield 24. Magnetic wand 22 is to be used by the wearer or another person to turn on and off hearing aid circuit 26. In one embodiment, magnetic wand 22 also allows the wearer or another person to cycle through various sound volume settings of hearing aid 10. Wand shield 24 is shaped to accommodate a portion of magnetic wand 22. Wand shield 24 is metal injection molded. Examples of the characteristics of the material of which wand shield 24 is made include magnetic shielding properties, stain and corrosion resistance, hypoallergenic, economical, and good appearance. In a specific embodiment, wand shield is made of stainless steel such as 300 series stainless steel.

Figure 19:
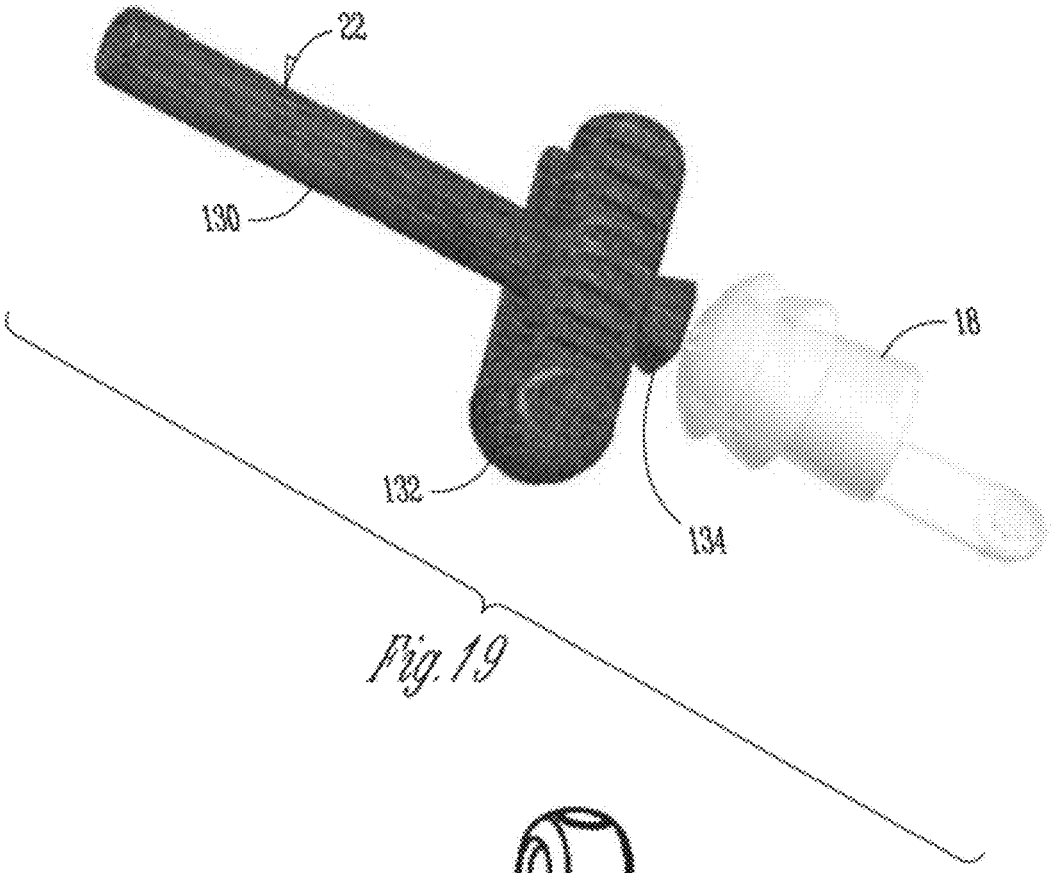
FIG. 19 is an illustration of an embodiment of the magnetic wand including a built-in cleaning tool.

FIG. 19 is an illustration of an embodiment of magnetic wand 22 including a built-in cleaning tool 134. In the illustrated embodiment, magnetic wand 22 includes a shaft 130 and a handle 132 that is rotatable about shaft 130 to expose built-in cleaning tool 134. In various embodiments, built-in cleaning tool 134 includes a brush or clean loop that may be used to clean receiver port 98 (such as removing earwax clogging the boomerang ports).

Figure 20:
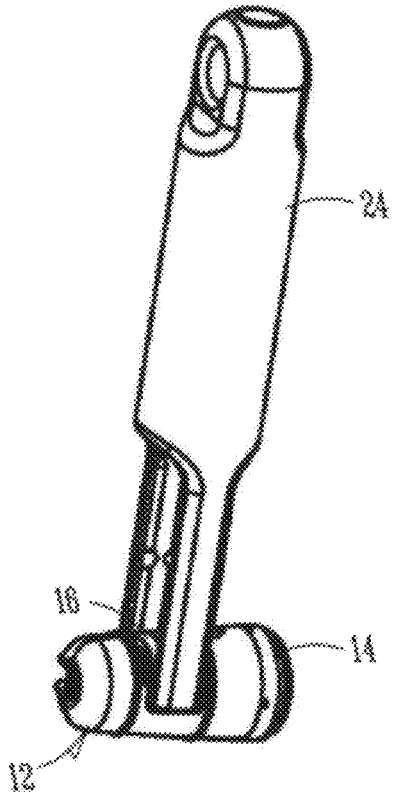
FIG. 20 is an illustration of an embodiment of using the wand shield as a battery removal tool.

FIG. 20 is an illustration of an embodiment of using wand shield 24 as a battery removal tool. In the illustrated embodiment, wand shield 24 is fork-shaped and sized to grip battery 16. To remove battery 16 from core module 14. Wand shield 22 is placed over battery 16 and pushed down to the wall of battery cradle 82 in positive stop. This results in a positive grip of battery 16 by wand shield 24. Battery 16 is then removed as wand shield 22 is retracted.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid for use in an ear canal, comprising:

a hearing aid circuit including a microphone having a microphone diaphragm, a receiver having a receiver diaphragm, and a processor circuit coupled between the microphone and the receiver; and a case housing the hearing aid circuit, the case including:

a unitary base structure being a continuous wall structure and including a rear portion housing at least the microphone and having a first opening, a front portion housing at least the receiver and having a second opening, and a middle portion configured to hold a battery, wherein the first opening and the second opening are on planes that are approximately perpendicular to each other, and the microphone diaphragm and the receiver diaphragm are approximately perpendicular to each other; and an end cap bonded to the base structure over the first opening, a snap cap seated on the end cap, and a slit formed between the end cap and the snap cap, the slit functioning as an inlet port for sound and air.

2. The hearing aid of claim 1, wherein the rear portion houses portions of the processor circuit.

3. The hearing aid of claim 1, wherein the case comprises a receiver lid bonded to the front portion of the base structure over the second opening, the receiver lid including a receiver port.

4. The hearing aid of claim 3, wherein the middle portion comprises a battery cradle configured to hold the battery, the battery cradle having a low-profile wall allowing the battery to be rolled out of the case.

5. The hearing aid of claim 4, wherein the hearing aid circuit comprises a tactile snap providing for confirmation that the battery is inserted in proper orientation.

6. The hearing aid of claim 1, wherein the slit has a 360-degree perimeter.

7. The hearing aid of claim 1, wherein the case comprises a collection chamber formed between the snap cap and the end cap and adjacent to the slit to collect earwax.

8. The hearing aid of claim 7, wherein the end cap comprises a neck ring including a plurality of radial ports to allow the sound and air to pass.

9. The hearing aid of claim 8, comprising a filter set including one or more filters each having a mesh allowing the air and sound to pass through a perimeter of the filter set, and wherein the neck ring is sized to accommodate the filter set.

10. The hearing aid of claim 1, further comprising a sleeve configured to accommodate a major portion of the case.

11. The hearing aid of claim 10, wherein the case has an exterior surface comprising raised ribs creating an acoustic and environmental seal between the case and the sleeve.

12. A hearing aid for use in an ear canal, comprising:

a microphone and processor module including a microphone having a microphone diaphragm and at least a portion of a processor circuit including a digital signal processor (DSP);

a receiver module including at least a receiver having a receiver diaphragm; and a case including a unitary base structure being a continuous wall structure including a microphone and DSP compartment housing the microphone and processor module, a receiver compartment housing the receiver module, a battery compartment coupled between the microphone and DSP compartment and the receiver compartment, an end cap bonded to the microphone and processor compartment, a snap cap seated on the end cap, and a slit formed between the end cap and the snap cap, the slit functioning as an inlet port for sound and air, wherein the microphone diaphragm is approximately perpendicular to the receiver diaphragm when the microphone and processor module is housed in the microphone and DSP compartment and the receiver module is housed in the receiver compartment.

13. The hearing aid of claim 12, wherein the microphone is bonded to the microphone and processor compartment using silicone and litz wires.

14. The hearing aid of claim 12, wherein the case is injection molded and made of a plastic material.

15. The hearing aid of claim 14, wherein the case is made of a nylon material.

16. The hearing aid of claim 12, wherein the microphone and DSP compartment comprises a rear cavity and a rear cavity opening, the rear cavity shaped to house the microphone and processor module and including molded-in guides for sliding the microphone and processor module into position.

17. The hearing aid of claim 16, wherein the receiver compartment comprises a front cavity and a front cavity opening, the front cavity shaped to house the receiver module, and the case comprises a receiver lid bonded to the receiver compartment over the front cavity opening.

18. The hearing aid of claim 16, wherein the end cap is bonded to the microphone and processor compartment over the rear cavity opening, and the slit has a 360-degree perimeter between the end cap and the snap cap.

19. The hearing aid of claim 18, wherein the case comprises a collection chamber formed between the snap cap and the end cap and adjacent to slit to collect earwax.

20. The hearing aid of claim 19, wherein the end cap comprises a neck ring including a plurality of radial ports to allow the sound and air to pass, and comparing one or more filters placed in the neck ring and each having a mesh allowing the air and sound to pass through.

21. The hearing aid of claim 12, wherein the microphone and DSP compartment has a first exterior surface, the receiver compartment has a second exterior surface, and the battery compartment comprises a battery cradle coupled between two substantially parallel walls being a portion of the first exterior surface and a portion of the second exterior surface.

22. The hearing aid of claim 21, comprising:

a battery held in the battery cradle; and a sleeve configured to accommodate a major portion of the case holding the battery.

23. The hearing aid of claim 22, wherein the sleeve is liquid injection molded and made of a soft rubber material.

24. The hearing aid of claim 16, wherein the microphone has a microphone diaphragm, the receiver has a receiver diaphragm, and the microphone diaphragm is approximately perpendicular to the receiver diaphragm when the microphone is housed in the front portion of the unitary base structure and the receiver module is housed in the rear portion of the unitary base structure.

* * * * *